United States Patent [19]

Mason

[11] Patent Number: 4,884,987

[45] Date of Patent: Dec. 5, 1989

[54] GONDOLA ATTACHMENT FOR HELIUM-FILLED TOY BALLOON

[76] Inventor: Charles P. Mason, 786 S. Merle, Wheeling, Ill. 60090

[21] Appl. No.: 282,396

[22] Filed: Dec. 9, 1988

[51] Int. Cl.[4] ..... A63H 27/10

[52] U.S. Cl. ..... 446/77; 446/225

[58] Field of Search ..... 446/225, 77, 71, 75, 446/76, 222

[56] References Cited

U.S. PATENT DOCUMENTS

| | | | |
|---|---|---|---|
| 1,478,755 | 12/1923 | Mulholland | 446/225 |
| 1,994,202 | 3/1935 | Sarsfield | 446/225 X |
| 4,145,838 | 3/1979 | Mason | 446/77 |
| 4,428,149 | 1/1984 | Brown | 446/222 |
| 4,784,628 | 11/1988 | McArdle et al. | 446/225 |

*Primary Examiner*—Mickey Yu

*Attorney, Agent, or Firm*—Charles F. Lind

[57] ABSTRACT

The disclosed toy balloon-gondola combination has an improved gondola that has an open top and a peripheral sidewall with spaced upper and lower edges. The gondola also has a cross member with means formed therein adapted to cooperate with the balloon fill stem, extended from an upper side of the cross member to a lower side thereof, for holding the balloon relative to the cross member. Two types of cross members are disclosed. One type of cross member is formed integrally with the gondola, and the gondola itself is of a special design. The other type of cross member is formed on a separate plug, adapted to be inserted into the open top of a conventional lightweight disposable drinking cup, and to become fixed relative to the sidewall thereof. In each embodiment, the cross member is located between the upper and lower edges of the gondola, to allow the balloon stem to be tensioned slightly as it connects the balloon and gondola together, and to draw the underside of the balloon against the upper edge of the gondola without unduely straining the secured components.

7 Claims, 2 Drawing Sheets

GONDOLA ATTACHMENT FOR HELIUM-FILLED TOY BALLOON

FIELD OF THE INVENTION

This invention relates to an aerial toy in the form of a helium-filled balloon, and specifically to an underlying basket or gondola adapted to be attached to and carried by the balloon.

BACKGROUND OF THE INVENTION

My U.S. Pat. No. 4,145,838 issued Mar. 27, 1979, for a TOY BASKET GONDOLA, disclosed an aerial toy in the form of a helium-filled balloon, and a gondola that could be secured to the balloon to be carried about thereby in a free-floating or tethered manner. The gondola illustrated was intended to be formed of a conventional lightweight disposable paper, plastic or foam cup, commonly used for drinking a beverage, having a closed bottom and an open top. In one embodiment, the balloon filling stem was secured to the conventional cup, by being fitted it through an opening formed or cut in the bottom wall of the cup. In other embodiments, different lids were illustrated that could be releasably secured to the open cup top, and the balloon filling stem was adapted to be secured to each lid.

When the balloon underside is snugged against the open cup top, particularly with appropriate markings on the balloon and cup, the toy can have an overall appearance quite similar to an actual hot-air balloon and gondola. The illustrated constructions of the patent do not consistently provide for this desired condition, without special efforts or care. Thus, when stretching the balloon filling stem to the bottom wall of the cup, excessive forces easily could be generated, that after time, could break the connection between the balloon or gondola component or either the balloon or gondola component itself. The lid connection, unless accurately made, left gaps between the balloon underside and the upper cup or gondola edge.

SUMMARY OF THE INVENTION

The present invention relates to an aerial toy using a helium-filled balloon, and specifically provides for gondola attachments that could be secured to the balloon to be carried about thereby in a free-floating or tethered manner.

In one embodiment of the invention, the gondola is specially designed, having a generally cup-shaped configuration with an exposed sidewall and having a cross wall disposed transverse to the sidewall at a location between upper and lower edges thereof, and having means on the cross wall to allow the balloon filling stem to be removably secured relative to this cross wall. The cross wall is spaced below the upper sidewall edge at a location suited to provide that the secured balloon filling stem will be drawn or stretched sufficiently to seat the underside of the balloon against the upper sidewall edge, but not excessively to break the connection or the balloon or gondola components.

In other embodiments of the invention, plug means are specifically designed, adapted to be inserted into the open top of a conventional throw-away beverage cup, to engage and become fixed to the cup sidewall at a location spaced below the upper edge thereof, again at a location suited to provide that the balloon filling stem can be secured thereto and when so secured can be drawn or stretched sufficiently to seat the underside of the balloon against the upper sidewall edge, but not excessively.

BRIEF DESCRIPTION OF THE DRAWINGS

Further advantages and features of the present invention will appear from the following description, and the accompanying drawings in which.

DETAILED DESCRIPTION OF ILLUSTRATED EMBODIMENTS

Figure 1:
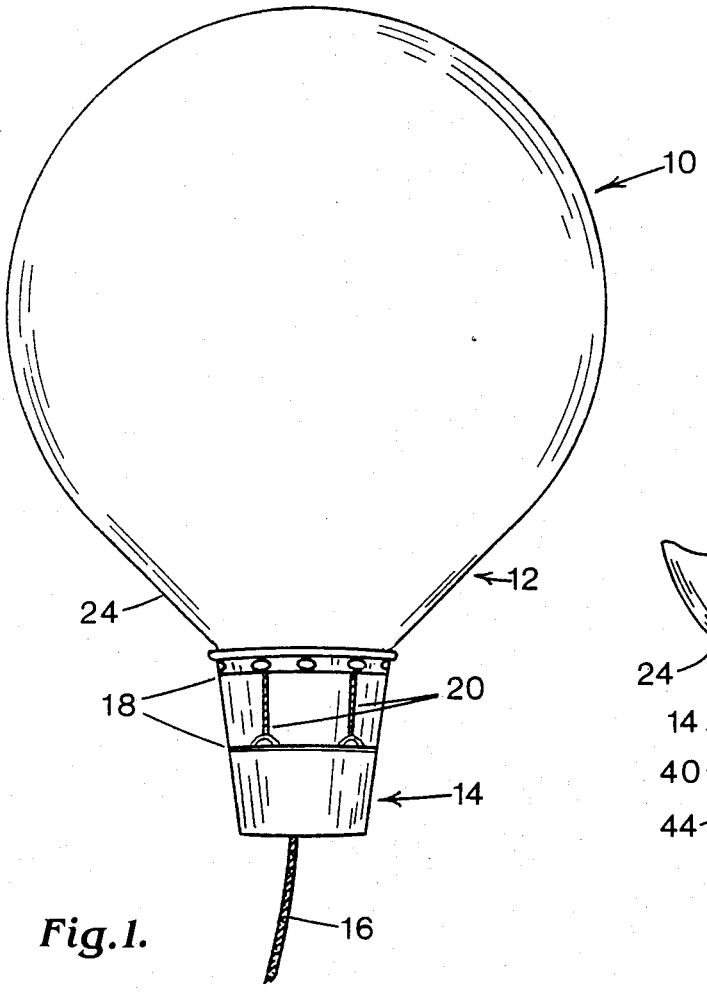
FIG. 1 is an elevational view of a toy balloon and gondola combination, illustrating also a tether line coming from the bottom of the gondola.

The illustrated aerial toy 10 consists of a helium-filled toy balloon 12 and a gondola 14 adapted to be mounted to the underside of the balloon. When sized properly, the toy balloon 12 will have sufficient buoyancy to become lighter than air, to lift itself and the gondola 14 into the air. Ballast (not shown) can be added to the gondola 14, to have the balloon and gondola effectively become weightless, relative to the air. Thus, in an enclosed room or in very still outdoor air, the weightless aerial toy 10 will float in the air, moving freely with the air currents. As the aerial toy 10, when weightless, will not fall or rise quickly, it can be handled or controlled quite easily. If desired, a tether line 16 may be attached to the gondola 14 for restricting the movement of the aerial toy 10.

For added realism, the toy balloon 12 and gondola 14 can be colorfully printed to look like a real hot-air balloon and gondola. This could include having peripherial markings 18 made on the outside of the gondola sidewall, and vertical markings 20 made between markings 18 and the top of the gondola 14 or the underside of the balloon 12, to give the illusion of a basket and flexible ropes connected between the balloon and basket. Alternatively or additionally, the balloon and/or gondola can be decoratively printed with advertising messages and/or logos.

Figure 10:
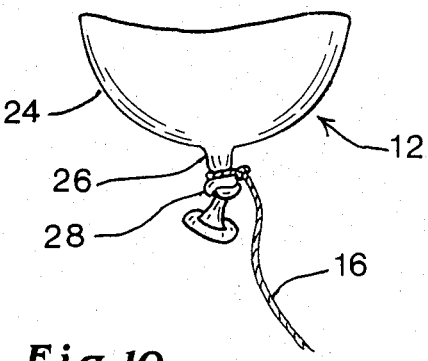
FIG. 10 is an elevational view of a typical knotted balloon filling stem, with which this invention is adapted to work.

The typical toy balloon 12 will have a large extendable sidewall 24 that converges in size to a much smaller somewhat elongated tubular stem 26 (see FIG. 10). The balloon is adapted to be filled through the stem 26, with helium or like gas; and the stem is then sealed. This may be done by tying a knot (as illustrated in FIG. 10) in the stem 26, or by closing a valve device (not shown) formed on or secured to the stem. In either situation, the knotted or valved stem 26 has a firm enlargement 28 therein, and between such enlargement and the balloon sidewall 24, any remaining stem is relatively soft and/or compressible. The tether line 16 can be secured onto the stem 26, in the region of the knotted or valved enlargement 28.

Figure 2:
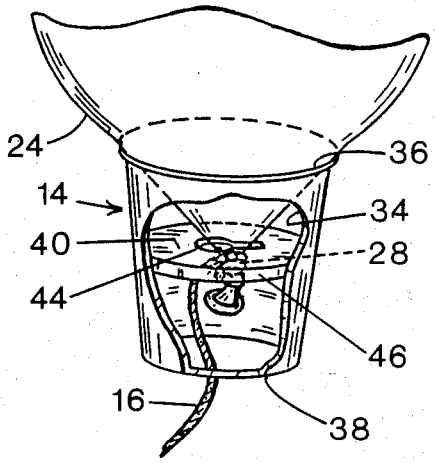
FIG. 2 is an enlarged perspective view, partly broken away and in section for clarity of disclosure, of the toy balloon and gondola combination of FIG. 1, illustrating the gondola construction and the manner of securing the balloon and gondola together.

FIG. 2 shows the gondola 14 partly cut-away, illustrating that it is somewhat in the form of an open-ended cup; having a slightly tapered tubular sidewall 34 extended between upper and lower generally circular edges 36 and 38, respectively. A cross wall 40 is permanently secured to the sidewall inside of the cup, spaced from and approximately midway between the upper and lower edges 36 and 38. A keyhole opening or slot 44 is formed or cut in the cross wall 40, having a somewhat circular portion (see FIGS. 7–9 also) offset from the longitudinal center of the cup and sufficiently large to have the firm enlargement 28 fit through it, and having a narrower portion centered relative to the cup and smaller than the firm enlargement 28.

The gondola 14 may be made of the same material used to make a conventional drinking cup, including: being of a coated paper, a thin plastic, or from a foamed plastic. Accordingly, the cross wall and defined cooperating opening 44 are dimentioanlly stable, relative to the balloon filling stem, while yet have limited flexibility and sufficient strength to allow the stem enlargement 28 to be intentionally fitted through the opening, to connect or disconnect the balloon relative to the cross wall, and to hold the balloon filling stem and cross wall together.

This provides that the firm enlargement 28 can be moved from the upper end of the gondola through the large part of the opening to the underside of the cross wall 40, and then the collapsible part of the stem above the enlargement can be centered and trapped in the narrow portion of the slot. The balloon filling stem 26, as so positioned, securely holds the balloon 12 relative to the cross wall 40. The spacing between the cross wall 40 and the upper sidewall edge 36 allows the balloon filling stem 26 to be stretched or extended slightly, sufficient to draw the balloon underside 24 snug against the upper edge 36 of the gondola. This eliminates, on the one hand, the need to stretch the balloon stem 26 excessively which could, after time and usage, break the connection or either the balloon or gondola component; and on the other hand, the problem of not having the balloon underside snugged against the upper gondola sidewall edge 36.

For use with a balloon of perhaps 12–20 inch diameter, the gondola may be 3–4 inch across at the upper edge (similar to a conventional drinking cup size), and the cross wall 40 should be perhaps 1–3 inches below the upper gondola edge 36. However, depending on the relative sizes and shapes of both the gondola and the balloon, these demensions may be varied slightly.

The slotted opening 44 can be made in forms other than a keyhole, such as a simple button hole opening, to accommodate a releasable connection between the knotted or valved balloon filling stem 26 and cross wall 40.

Figure 6:
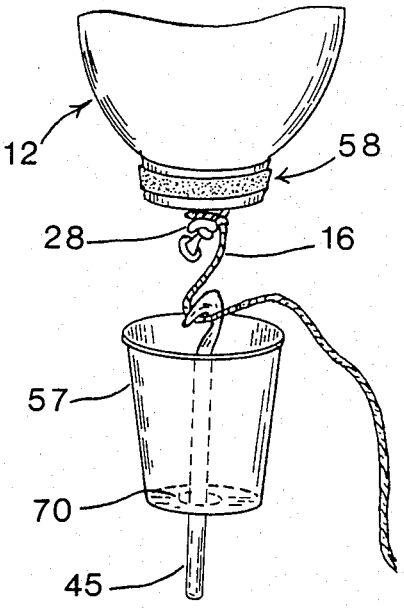
FIG. 6 is an elevational perspective view similar to FIG. 5, except showing the balloon and plug, and the gondola in a position before they have been secured together, with the use of a tool somewhat as illustrated.

The tether line 16 can be fitted through the slotted opening 44 from above the cross wall 40, and it and the balloon stem can be pulled downwardly from the open bottom end of the gondola, to have the balloon underside seated or snugged against the upper sidewall edge 36 of the gondola 14. A crochet needle or like tool 45 may be inserted through the opening 44 from the underside of the cross wall 40 (as illustrated in FIG. 6) to hook onto and pull the tether line 16 through the opening from the upper side of the cross wall.

In FIG. 2, the cross wall 40 is permanently secured at its periphery 46 to the gondola or cup sidewall 34. This would be done by the manufacturer of the gondola. With a paper product cup, a separate cross wall may be secured by adhesive at the periphery; or with either a solid or foamed plastic gondola, the sidewall 34 and cross wall 40 may be integral with one another at the periphery 46.

Figure 3:
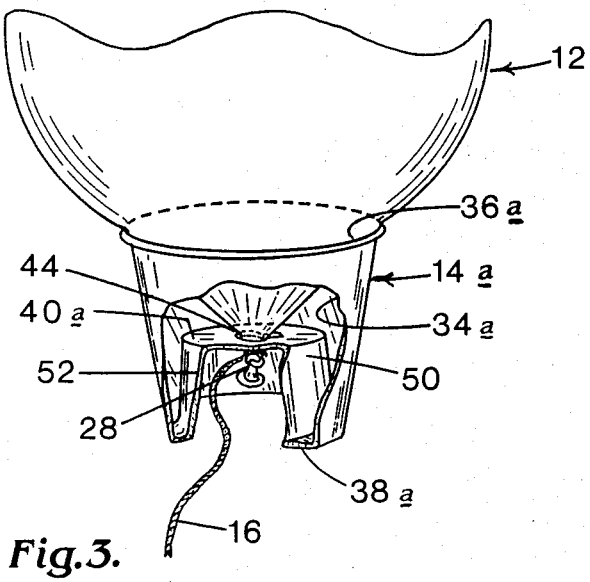
FIG. 3 is an enlarged perspective view, partly broken away and in section, of another embodiment of toy balloon and gondola combination.
Figure 4:
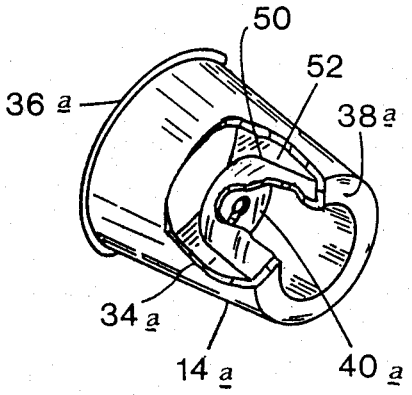
FIG. 4 is a bottom-side perspective view, again partly broken away and in section, of the gondola of FIG. 3 illustrated by itself.

FIGS. 3 and 4 show, again in cutaway versions, a condola **14*a* having slightly tapered sidewall 34*a* terminating at upper and lower edges 36*a* and 38*a*. An inverted cup-like configuration 50 is located inside the gondola cup sidewall 34*a*, the cup 50 having an upstanding sidewall 52 and a cross wall 40*a*. The two upstanding sidewalls 34*a* and 52 are joined together at or near the open lower edge 38*a*. This would typically be done by the manufacturer of the gondola . . . by bonding separate components, or by forming them integrally of one another. The cross wall 40*a* illustrated has the opening means 44 therein, adapted to receive the knotted or valved filling stem of toy balloon 12, to make the securing connection between the balloon and gondola. As illustrated, the tapers of the sidewall 34*a* and 52 are opposite to one another, allowing like gondolas 14*a*** to be axially stacked or telescoped together, as is commonly done with conventional throw-away drinking cups.

As each gondola 14 and **14*a* is complete, where no additional parts are needed during assembly with or connection to the balloon, to form the aerial toy, either gondola style could most conveniently be sold and/or used by vendors at sales counters, picnics, carnivals or the like. The cross wall 40 or 40*a*, being exposed from the open bottom of the gondola, allows for easy finger manipulation into the open bottom end to lock the balloon stem in place within the opening 44**.

Figure 5:
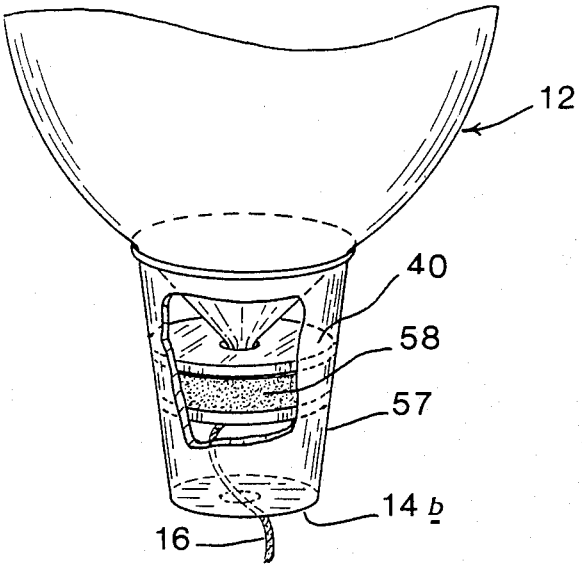
FIG. 5 is an elevational perspective view, again partly broken away and in section for clarity of disclosure, of another embodiment of toy balloon and gondola combination, and illustrating a balloon holding plug for securing the balloon and gondola together.
Figure 7:
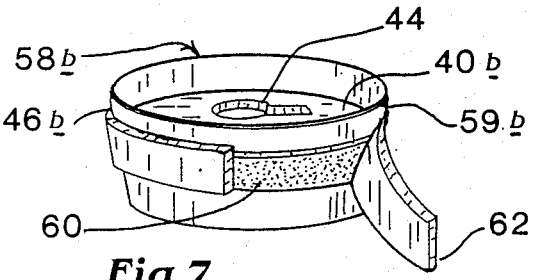
FIGS. 7, 8 and 9 are perspective views of alternate balloon holding plugs used to form the toy balloon and gondola combination of FIG. 5 and 6.
Figure 8:
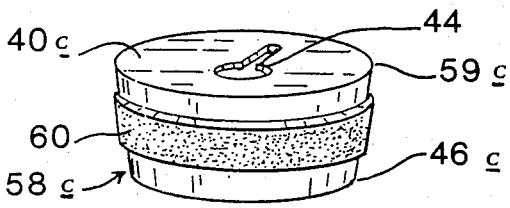
Figure 9:
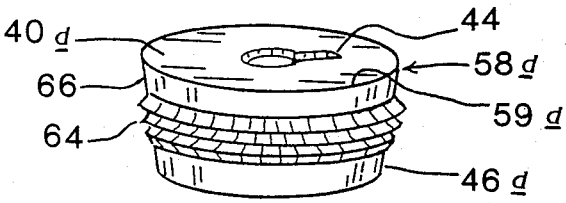

FIG. 5 shows a cutaway view of an alternative gondola **14*b* and balloon 12 combination secured together, with tether line 16 depending from the bottom end thereof; whereas FIG. 6 shows a cutaway view of the individual gondola and balloon components, before they are secured together. With this combination, a conventional lightweight disposable drinking cup 57 (formed of a coated paper, a thin plastic, or a foamed plastic) would be used, along with a special separate plug or balloon holder 58 that is connected to the cup to from the gondola 14*b*. FIGS. 7, 8 and 9 show three forms of plugs or balloon holders 58*b*, 58*c* and 58*d***.

Each of the plugs **58*b*, 58*c* and 58*d* has a sidewall 46*b*, 46*c* or 46*d* tapered to fit substantially flush against the inside face of the cup sidewall 34*b*, axially a distance of the order between ½ and 1 inch. In FIG. 7, a cross wall 40*b* is connected to the tapered sidewall 46*b*, below the upper edge 59*b* thereof; while in FIGS. 8 and 9, a cross wall 40*c* and 40*d* is connected to the tapered sidewall, at the upper edge 59*c* and 59*d* thereof. The balloon-attaching opening means 44 is formed in each of the cross wall 40*b*, 40*c* and 40*d***.

The plugs 58b and 58c further have adhesive 60 coated on each sidewall 46b and 46c, as a peripherial band that is covered before the plug is to be used by a removable strip of tape 62, as illustrated in FIG. 7. Upon removal of the tape 62 from either plug 58b or 58c, the plug may be pushed into the open end of the cup until it engages the cup sidewall, and the adhesive 60 is adapted to adhere then to the gondola sidewall.

Plug 58d (FIG. 9) has barbs 64 projecting from the plug sidewall 46d, the barbs having sloping peripherial faces ending at radial shoulders 66 facing the upper edge 59d. The plug barbs 64 are adapted to be easily inserted into the cup to engage and radially deform the gondola sidewall slightly, whereupon the shoulders 66 would dig into the cup sidewall upon attempted withdrawal from the cup, to anchor the plug and gondola together. This plug would typically be most used with a foamed cup having a relatively soft deformable sidewall, and would itself be made of a harder plastic capable of deforming the cup sidewall.

The plug diameter would determine how far the plug could be inserted into the cup before contacting the cup sidewall. The plug would be sized to cooperate with a typical cup size, to contact the cup sidewall at an approximate plug debth below the upper cup edge 36, suited for making the balloon connection to the gondola; although generally some latitudue is allowed in establishing this plug location. In many situations, it is also possible to vary the plug location somewhat, by squeezing the cup sidewall 34b slightly to engage and establish sufficient contact pressure between the plug and cup, to bond them together. These factors provide a more universal use of one plug with different styles and/or sizes of cups, in forming the gondola, to reduce plug inventory.

The gondola used in combinations of FIGS. 5–9 can be a common beverage cup found in most fast food places. The helium filled balloon, tethered by a line, may be sold together with the beverage filled cup. The plug 58 may also be secured to the filled balloon stem. After consuming the drink, the balloon and the plug, attached together, can be secured to the gondola cup.

To do this, a hole 70 would be punched through the bottom wall of the cup 57, and as noted, hooking tool 45 may be inserted through the hole from the bottom to pull the tether line 16 through the bottom opening, as is illustrated in FIG. 6. As the tether line 16 is pulled from the bottom of the cup condola, the plug and balloon are pulled into the top opening of the gondola cup until snugged against the sidewall.

The plug may alternatively first be secured to the cup and the balloon stem may then be connected to the cross wall; but more of the bottom cup wall would probably have to be removed to provide sufficient space to make the connection between the balloon stem 26 and cross wall 40.

The plug 58b of FIG. 7, with the recessed cross wall 40b, gives additional space between the cross wall and upper sidewall edge 36, allowing the balloon stem to be extended or stretched somewhat further in drawing the underside of the balloon against the upper edge of the gondola.

The disclosed invention provides an exciting and appealing aerial toy, of a helium-filled balloon and gondola; and the gondola may be either a special design or a conventional lightweight disposable drinking cup. The valved or knotted balloon stem of the filled balloon, may be secured to the cross wall of the gondola, to unite the balloon and gondola components together.

What is claimed as my invention is:

1. In a toy balloon-gondola combination having a helium-filled balloon with a filling stem, and a gondola adapted to be secured to the balloon stem with the latter substantially hidden within the gondola, the improvement comprising:

said gondola being in the form of a tubular member having a peripheral sidewall with upper and lower edges, a cross member, and an inner sidewall;

said inner sidewall lying adjacent said peripheral sidewall and being integral therewith at its lower end and otherwise being inwardly spaced therefrom and being integral at its upper end with the cross member;

means on the cross member adapted to cooperate with the balloon stem, when the stem is extended from an upper side of the cross member to a lower side thereof, for securing the balloon stem and cross member together;

said gondola tubular member being open at its upper and lower ends and said cross member being manually accessible from both the upper and lower open ends;

said cross member being at a location spaced intermediate said upper and lower edges of the peripheral sidewall, for holding the balloon relative to the gondola, with the balloon underside drawn against the upper edge of the peripheral sidewall; and said peripheral sidewall and said inner sidewall each being tapered, in the opposite directions, with the peripheral sidewall converging from a wider open upper end toward the lower end to allow like gondola tubular members to be nested within one another via the open upper end.

2. In a toy balloon-gondola combination having a helium-filled balloon with a filling stem, and a gondola adapted to be secured to the balloon stem with the latter substantially hidden within the gondola, the improvement comprising:

said gondola being in the form of a conventional cup having a tapered peripheral sidewall with upper and lower end edges, an open upper end, and a closed lower end smaller than the upper end;

a plug initially separate from the cup and having a cross member and a tapered peripheral side member with an upper wide edge and a lower narrower edge, and being sized to be manually fitted into the upper open end of the cup until the tapered peripheral side member abuts against the cup sidewall with said cross member spaced intermediate said upper and lower edges of the peripheral sidewall;

means on the cross member adapted to cooperate with the balloon stem, when the stem is extended from an upper side of the cross member to a lower side thereof, for securing the balloon stem and cross member together;

the tapers of the plug side member and peripheral sidewall being substantially the same to fit substantially flush against one another, and upon the toy balloon-gondola combination first being assemblied, said plug being manually fitted into the upper open end of the cup to abut the tapered side member substantially flush against the cup sidewall and to space the cross member intermediate said upper and lower edges of the peripheral sidewall; and means effective upon such abutment of the tapered side member against the cup sidewall to secure the plug side member and the peripheral sidewall together, as so positioned operable for holding the balloon relative to the cup, with the balloon underside drawn against the upper edge of the peripheral sidewall.

3. In the toy balloon-gondola combination according to claim 2, further providing said means for securing the plug side member and the peripheral sidewall together being in the form of adhesive on the peripheral side member adapted to become bonded on contact to the peripheral sidewall.

4. In the toy balloon-gondola combination according to claim 3, further providing a removable tape adapted to cover the adhesive on the plug side member, before the plug is to be secured in place within the gondola.

5. In the toy balloon-gondola combination according to claim 2, further providing said cup is of foamed plastic, and said means for securing the plug side member to the peripheral sidewall being in the form of interlocking barbs on the plug side member adapted to be snugged against the peripheral cup sidewall to mechanically hold them together.

6. In the toy balloon-gondola combination according to claim 2, further providing a tether line secured to the balloon filling stem, and means including an opening formed in the closed lower end of the cup, upon the toy balloon-gondola combination first being assemblied, for feeding the tether line through and allowing the balloon stem to be pulled by the tether line downwardly from the open top of cup to have the balloon underside snugged against the upper sidewall edge of the cup.

7. In the toy balloon-gondola combination according to claim 6, further providing an elongated tool, operable to be inserted through the opening in the lower end of the cup from the underside of the cup operable to hook onto and pull the tether line through the opening in the direction from the upper side thereof to below the lower cup end.

* * * * *